US007481971B2

(12) United States Patent
Coupland et al.

(10) Patent No.: US 7,481,971 B2
(45) Date of Patent: Jan. 27, 2009

(54) IRIDIUM ALLOY

(75) Inventors: Duncan Roy Coupland, High Wycombe (GB); Robin Hyde, Letchworth (GB)

(73) Assignee: Johnson Matthey Public Limited Company, London (GB)

( * ) Notice: Subject to any disclaimer, the term of this patent is extended or adjusted under 35 U.S.C. 154(b) by 217 days.

(21) Appl. No.: 10/521,217

(22) PCT Filed: Jul. 11, 2003

(86) PCT No.: PCT/GB03/03037

§ 371 (c)(1),
(2), (4) Date: Jul. 14, 2005

(87) PCT Pub. No.: WO2004/007782

PCT Pub. Date: Jan. 22, 2004

(65) Prior Publication Data

US 2006/0165554 A1 Jul. 27, 2006

(30) Foreign Application Priority Data

Jul. 13, 2002 (GB) ..... 0216323.6

(51) Int. Cl.
*C22C 28/00* (2006.01)

(52) U.S. Cl. ..... 420/461

(58) Field of Classification Search ..... 420/461; 313/141

See application file for complete search history.

(56) References Cited

U.S. PATENT DOCUMENTS 3,262,779 A 7/1966 Price et al.
3,293,031 A 12/1966 Rhys et al.
3,918,965 A 11/1975 Inouye et al.
3,970,450 A 7/1976 Liu et al.
6,885,135 B2 * 4/2005 Kanao et al. ..... 313/141
6,885,136 B2 * 4/2005 Orjela et al. ..... 313/141
2002/0003389 A1 * 1/2002 Ishiguro ..... 313/141

FOREIGN PATENT DOCUMENTS

EP 0 866 530 A1 9/1998
GB 1051224 12/1966

(Continued)

OTHER PUBLICATIONS

C. Huang et al., "Ir-Based Refractory Superalloys by Pulse Electric Current Sintering (PECS) Process (II Prealloyed Powder)," *Journal of Materials Engineering and Performance*, vol. 11, No. 1, Feb. 2002, pp. 32-36.

*Primary Examiner*—Deborah Yee
(74) *Attorney, Agent, or Firm*—RatnerPrestia

(57) ABSTRACT

An iridium alloy consists essentially of iridium and at least one of W and Zr, and optionally Rh. When present, W comprises between 0.01 and 5 wt % of the alloy; when present in combination with W, Zr comprises between 0.01 and 0.5 wt % of the alloy; when present alone or in combination with Rh only, Zr comprises between 0.01 and 0.09 wt % of the alloy; and when present, Rh comprises between 0.1 and 5 wt % of the alloy. The alloys may be modified by the addition of platinum and other platinum group metals and base metals. The alloys demonstrate enhanced physical and chemical properties and are suitable for use as electrode materials in spark plugs and other high temperature applications.

14 Claims, 3 Drawing Sheets

FOREIGN PATENT DOCUMENTS

| | | | |
|---|---|---|---|
| JP | 1-119595 | | 5/1989 |
| JP | 6-112261 | * | 4/1994 |
| JP | 10-162931 | | 6/1998 |
| JP | 10-259435 | * | 9/1998 |
| JP | 2000-290739 | | 10/2000 |
| JP | 2002-327266 | * | 11/2002 |
| WO | WO-00/21110 | | 4/2000 |

* cited by examiner

IRIDIUM ALLOY

This application is the U.S. national phase application of International Application No. PCT/GB2003/003037, filed Jul. 11, 2003, and claims priority of British Application No. 0216323.6, filed Jul. 13, 2002.

This invention relates to alloys of iridium, in particular to alloys of iridium with low amounts of alloying elements and uses thereof.

Iridium is a member of the platinum group of metals and has a variety of applications including automobile catalysts, electrodes for industrial electrolysis, crucibles for crystal growth, thermocouples, rocket motor parts, glass making and spark plugs. It has several attractive properties including a very high shear modulus at room temperature and elevated temperature strength second only to tungsten among the refractory metals. It is also thought to be the most corrosion resistant of all metals.

However, despite these benefits there are some disadvantages. Its mechanical properties are sensitive to certain low level impurities and strain rate and it also exhibits a ductile-brittle transition. Due to the rarity of its occurrence in nature its price per gram is of the same order as platinum and furthermore its density is the second highest of all elements. Finally, although compared to the refractory metals its resistance to oxidation is excellent, it nevertheless does exhibit a significant weight loss at elevated temperature under oxidising conditions.

As a result of its scarcity and difficulty in maintaining metal purity during manufacture, the metallurgy of iridium is poorly understood. Indeed little work, relative to that done on alloying of platinum for instance, has been carried out to investigate the effect of alloying on properties. However, the alloying with some elements has been investigated by different workers. Oak Ridge National Laboratories in the USA have been responsible for developing one alloy, DOP-26 based on Ir-0.3W+Th, for radioisotope thermoelectric generator casings used to supply power to spacecraft. Tungsten has been shown to increase the alloy re-crystallisation temperature of iridium by 400° C. at >2 wt % addition, which makes control of microstructure during hot working, much simpler. Thorium has been shown to promote ductility below the normal ductile/brittle transition zone, although its radioactivity is a major disadvantage when considering this alloy for normal commercial applications. Certain Rare Earth elements, Ce, Y and Lu have also been investigated, and Ce has been found promote similar properties to Th, although less pronounced. ORNL have developed a new alloy range based on Ir-0.3 W with low levels of Ce+Th.

U.S. Pat. No. 3,918,965 describes a binary alloy of iridium with 0.3 to 1 wt % hafnium. Improvements in physical properties are claimed.

Work has been limited in respect of alloying iridium with platinum group metals (PGM). Rhodium additions, up to a maximum of ca. 10 wt %, have been shown to improve oxidation resistance, ductility and formability. Application of 40% Rh—Ir to novel rocket nozzles was reported in the early 1990's. Ternary alloys have also been long considered for pen nibs, and electrodes. The advent of long life spark plugs has re-invigorated interest in the potential of iridium alloys. Rhodium additions have been found to be beneficial, with 40 wt % being best for oxidation resistance. Additions of 10 wt % of both platinum and palladium also improve the oxidation resistance of iridium, although not as effectively as rhodium. Al, Si, Cr, Mo and W were found to be ineffective.

EP0866530 A1 discloses ternary and quaternary alloys of iridium, rhodium and at least one of rhenium and ruthenium.

Low levels of Re and Ru, either singly or combined, significantly reduce the oxidation loss of an alloy at 1100° C. for 30 hours, compared to pure iridium. The presence of rhodium is essential, as Re and Ru have little or no effect when combined with iridium alone.

JP 2000290739 A discloses an alloy for the formation of crucibles which can be used at high temperatures without significant deformation or oxidation. The alloy is a binary or ternary alloy of iridium with 0.5-40 wt % of Rh and/or Pt.

JP 10259435 A discloses a heat resistant iridium alloy which comprises a base of iridium to which 0.1 to 50 wt % of one or more secondary elements is added. Platinum, palladium, rhodium, niobium, tantalum, hafnium, titanium, zirconium, yttrium and lanthanum are suggested as secondary elements however actual examples of only some of these are given, none of which contain secondary elements at less than 1 wt %.

U.S. Pat. No. 3,970,450 discloses alloys formed from a base of pure iridium or iridium-0.3 wt % W, to which small amounts each of aluminum, iron, nickel, rhodium and thorium are added. The alloys are useful for the encapsulation of radioactive sources so the use of thorium can be tolerated. Thorium containing alloys are not usually suitable for general application.

U.S. Pat. No. 3,293,031 discloses a ductile ternary iridium alloy containing up to 0.5 wt % of both titanium and zirconium.

Although prior attempts to improve the physical and mechanical properties of iridium by alloying have met with some success, there remains a need for further improvements.

In accordance with the present invention, an iridium alloy consists essentially of iridium, at least one of W and Zr and optionally Rh; wherein when present, W comprises between 0.01 and 5 wt % of the alloy; wherein when present in combination with W, Zr comprises between 0.01 and 0.5 wt % of the alloy; wherein when present alone or in combination with Rh only, Zr comprises between 0.01 and 0.09 wt % of the alloy; and wherein when present, Rh comprises between 0.1 and 5 wt % of the alloy.

Preferably, when present, W comprises between 0.01 and 0.5 wt % of the alloy; when present in combination with W, Zr comprises between 0.01 and 0.5 wt % of the alloy; and when present alone or in combination with Rh only, Zr comprises between 0.02 and 0.07 wt % of the alloy.

It will be understood that whilst the amounts of each component are given assuming that the base alloy is pure iridium, in practical terms, the iridium and the alloying elements may contain impurities at levels which would normally be expected for such metals.

The alloys of the present invention show enhanced physical and mechanical properties over pure iridium.

The alloy of the present invention may be modified by the addition of Pt in an amount of between 0.1 and 5 wt % of the alloy.

Additionally or alternatively, the alloy of the present invention may be modified by the addition of one or more of Ta, Nb, Mo, Cr, Ce, Sc, Lu, Co, Ni, Hf, Y, Ti, Ru and Pd individually in an amount of between 0.01 and 10 wt % of the alloy.

Preferably, when present, Ta, Nb, Mo, Cr, Ce, Sc, Lu, Co, Ni, Hf; Y and Ti individually comprise between 0.01 and 0.5 wt % of the alloy; and when present, Ru and Pd individually comprise between 0.1 and 5 wt % of the alloy.

In a preferred embodiment, the alloy consists essentially of iridium, W and Zr.

In a further preferred embodiment, the alloy consists essentially of iridium and W.

In a yet further preferred embodiment, the alloy consists essentially of iridium and Zr.

In measurements of stress rupture times at elevated temperatures, these alloys may outperform pure iridium by a factor of twenty or more. Creep rates at high temperature are also significantly reduced. Furthermore, W and Zr may also retard grain growth at high temperature, with small additions of both W and Zr being found to reduce the rate of grain growth at high temperature by a factor of two compared to pure iridium.

In a yet further preferred embodiment, the alloy consists essentially of iridium, Rh, W, and Zr.

In a yet further preferred embodiment, the alloy consists essentially of iridium, Pt, Rh, W and Zr.

Significant reduction in weight loss under high temperature oxidising conditions is found for these alloys, when compared to pure iridium.

In a yet further preferred embodiment, the alloy consists essentially of iridium, Rh and W.

In a yet further preferred embodiment, the alloy consists essentially of iridium, Rh and Zr.

In a yet further preferred embodiment, the alloy consists essentially of iridium, Pt, Rh and W.

In a yet further preferred embodiment, the alloy consists essentially of iridium, Pt and W. In tensile tests, these alloys demonstrate a considerable increase in elongation to failure compared to pure iridium. In some cases, elongation to failure is increased two-fold and more.

The enhanced physical and mechanical properties of the alloys of the present invention make them suitable for use in many high temperature or load bearing applications. For example, they may be used in ignition applications i.e. as components in spark-plugs or as crucibles, e.g. for crystal growing or other equipment in chemical and glass applications where high strength, low creep rate and good oxidation resistance are required. Other applications include electrodes, heat shields and rocket nozzles. The foregoing examples merely serve to illustrate the many potential uses of the present alloys, and as such, are not intended to be limiting in any way.

The alloys may be manufactured by known methods and fabricated into any suitable physical form. Improvements in elongation to failure, or ductility, make the alloys particularly suitable for drawing into wires however, tubes, sheets, grains, powders or other common forms are also contemplated. The alloys may also be used in spray coating applications.

The invention will now be described by way of example only and with reference to the following drawings in which.

EXAMPLE 1

Alloy Preparation

The alloys detailed in table 1 below were prepared by argon arc melting. All values are given in weight percent based on the total weight of the alloy. Balance in all cases is iridium.

TABLE 1

| Alloy | W | Zr | Rh | Pt | Other |
|---|---|---|---|---|---|
| 1 | 0.3 | — | — | 0.2 | — |
| 2 | — | 0.07 | — | — | — |
| 3 | 0.3 | 0.02 | — | — | — |
| 4 | 0.05 | — | — | — | — |
| 5 | 0.02 | 0.02 | — | — | — |
| 6 | 0.3 | 0.07 | 2.5 | — | — |
| 7 | 0.3 | 0.07 | 2.5 | 2.5 | — |
| 8 | 0.3 | — | 2.5 | 2.5 | — |
| 9 | 0.5 | — | 1.0 | — | — |
| 10 | 0.3 | — | 1.0 | 1.0 | — |
| 11 | 0.3 | — | 1.0 | 5.0 | — |
| 12 | 1.0 | — | 1.0 | — | — |
| 13 | 2.0 | — | 2.5 | — | — |
| 14 | 0.5 | — | 2.5 | — | — |
| 15 | — | 0.07 | 2.5 | — | — |
| 16 | 0.3 | — | — | — | — |
| 17 | — | — | 2.5 | — | Ta (0.5) |
| 18 | — | — | 2.5 | — | Nb (0.25) |
| 19 | — | — | 2.5 | — | Mo (0.25) |
| 20 | — | — | 2.5 | — | Cr (0.15) |
| 21 | — | — | 2.5 | — | Pd (0.3) |
| 22 | 0.05 | — | — | 5.0 | — |
| 23 | 0.05 | — | 0.5 | 5.0 | — |
| 24 | 0.3 | — | 5.0 | 1.0 | — |

EXAMPLE 2

Elongation to Failure

Figure 1:
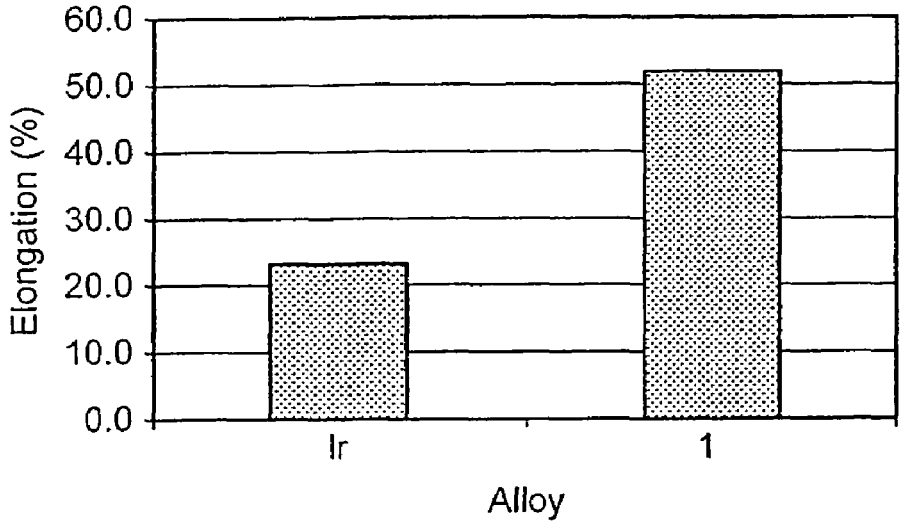
FIG. 1 is a bar chart comparing the mean elongation at room temperature of an alloy according to the present invention with pure iridium.

Alloy 1 was hot drawn into wires of 1.8 mm diameter, and subjected to tensile testing with a gauge length of 51 mm and a cross head speed of 5 mm/minute. The result is shown in FIG. 1. Addition of Pt and W at the ppm level significantly improved the room temperature mechanical properties of the alloy. Although ultimate tensile strength was found to only be improved marginally, elongation to failure increased by 117% relative to similar wires of pure iridium.

EXAMPLE 3

Stress Rupture

Figure 2:
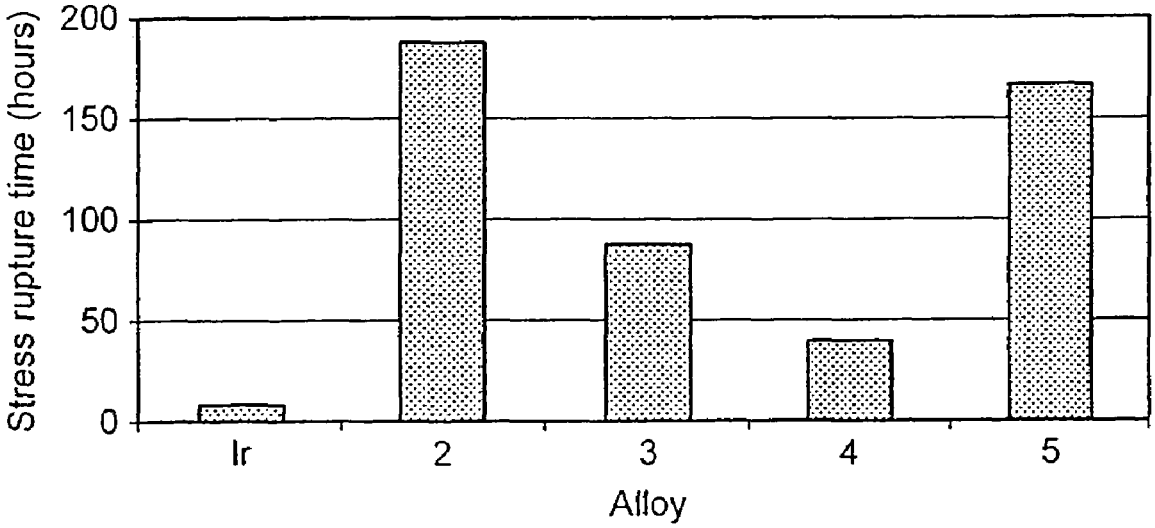
FIG. 2 is a bar chart comparing the stress rupture time at elevated temperature of four alloys according to the present invention with pure iridium.

Alloys 2-5 were hot rolled into sheets and tensile sample blanks formed by spark erosion machining. These were then surface ground to a thickness of nominally 1.8 mm. The gauge length of each sample blanks was 30 mm. Stress rupture times were measured at a temperature of 1400° C. and stress of 75 MPa Results are shown in FIG. 2. Significant improvements in stress rupture times were found for all alloys compared to pure iridium, with ppm levels of Zr (alloy 2) or Zr and W (alloy 5) being most effective. Although not shown in FIG. 2, creep rates at elevated temperature were also reduced, in some cases by as much as a factor of 16 compared to pure iridium.

EXAMPLE 4

Grain Growth Retardation

Figure 3:
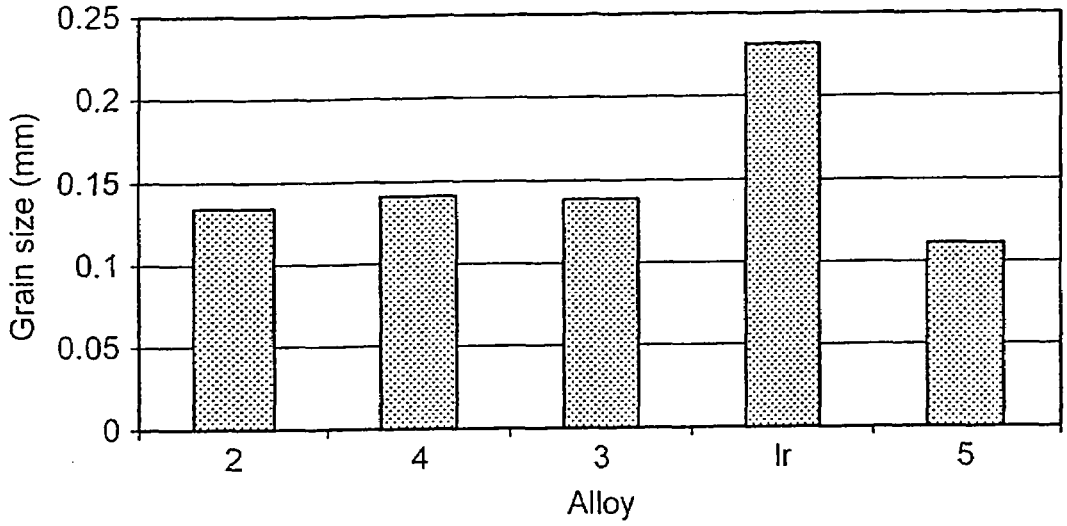
FIG. 3 is a bar chart comparing the rate of grain growth at elevated temperature of four alloys according to the present invention with pure iridium.

Alloys 2-5 as detailed in table 1 above, were hot rolled into sheet of nominally 3.5 mm thickness. The alloys were held at 1550° C. for 400 hours and grain size measurements made. This was done using an optical microscope. The number of grains intersecting a line traversing the polished and etched section were counted and averaged over the cross sectional thickness. Results are shown in FIG. 3. Grain growth was reduced for all alloys compared to pure iridium, with ppm levels of Zr and W (alloy 5) showing a halving of grain size.

EXAMPLE 5

Oxidation Weight Loss

Figure 4:
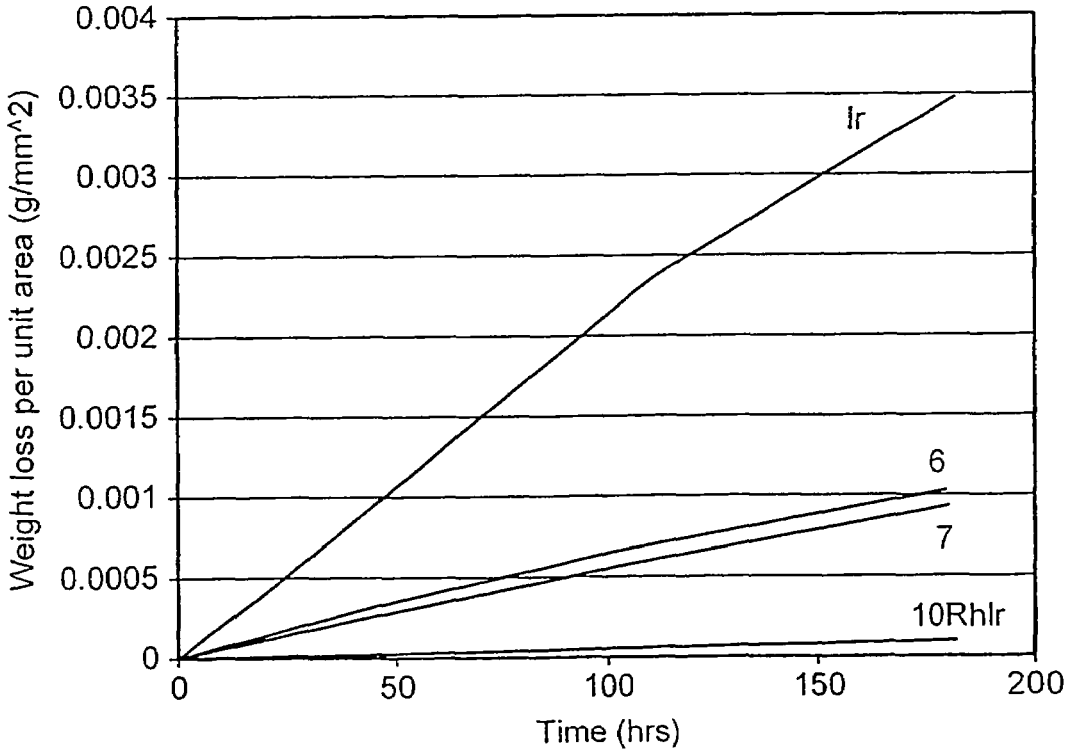
FIG. 4 is a graph comparing the measured weight loss of two alloys according to the present invention with pure iridium.

Alloys 6 and 7, as detailed in table 1 above, were hot drawn into wires of between 0.6 and 1.2 mm and their weights monitored while being held at 1000° C. for 200 hours. Results are shown in FIG. 4. The weight loss of both alloys was approximately 4 times less than that for pure iridium, over the duration of the test, and approached that which was found for a commercial 10 wt % Rh—Ir alloy.

Figure 5:
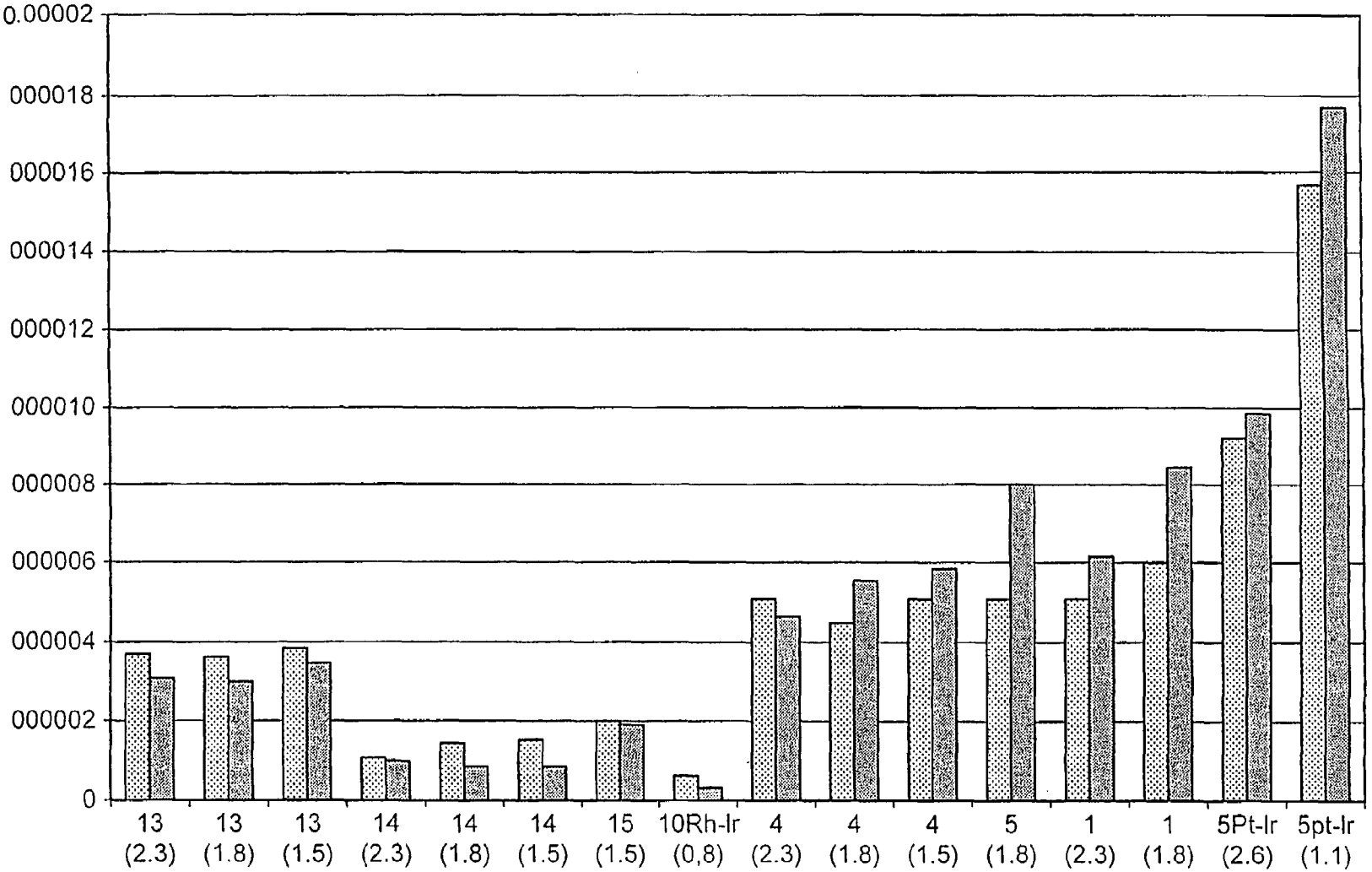
FIG. 5 is a bar chart comparing the oxidation rate at two temperatures of several alloys according to the present invention with commercial iridium alloys.

Further oxidation weight loss experiments were carried out using wires of different thicknesses formed from alloys according to the present invention. FIG. 5 shows the weight loss rates of alloys 1, 4, 5, 13, 14 and 15. The heavily shaded bars in FIG. 5 represent experiments carried out at 1000° C. and the lighter shaded bars represent experiments carried out at 1100° C. The figure in brackets refers to the thickness of the wire in mm. Oxidation rate is expressed in g/mm·hour. All alloys showed a significant reduction in oxidation rate compared to a 5% Pt—Ir alloy.

EXAMPLE 6

Engine Tests

Alloys 6 and 7, as detailed in table 1 above, were formed into spark plug electrodes. During testing in a high performance car engine over a period of 175 hours, the electrodes were found to erode at a similar rate to commercial 10 wt % Rh—Ir alloy electrodes, and at a much reduced rate compared to pure iridium electrodes.

The invention claimed is:

1. An iridium alloy, consisting essentially of iridium, Rh, W and Zr; wherein the Rh comprises between 0.1 and 2.5 wt % of the alloy; wherein W comprises between 0.01 and 5 wt % of the alloy; and wherein Zr comprises between 0.01 and 0.5 wt % of the alloy.

2. An iridium alloy according to claim 1, wherein W comprises between 0.01 and 0.5 wt % of the alloy.

3. An alloy comprising an iridium alloy consisting essentially of iridium, Rh, W, Zr and Pt; wherein the Rh comprises between 0.1 and 2.5 wt % of the alloy; wherein W comprises between 0.01 and 5 wt % of the alloy; wherein Zr comprises between 0.01 and 0.5 wt % of the alloy; and wherein Pt comprises between 0.1 and 5 wt % of the alloy.

4. An alloy comprising an iridium alloy consisting essentially of iridium, Rh, W, Zr and one or more elements selected from the group consisting of Ta, Nb, Mo, Cr, Ce, Sc, Lu, Co, Ni, Hf, Y, Ti, Ru and Pd individually in an amount of between 0.01 and 10 wt % of the alloy; wherein the Rh comprises between 0.1 and 2.5 wt % of the alloy; wherein W comprises between 0.01 and 5 wt % of the alloy; and wherein Zr comprises between 0.01 and 0.5 wt % of the alloy.

5. An alloy according to claim 4, wherein when present, Ta, Nb, Mo, Cr, Ce, Sc, Lu, Co, Ni, Hf, Y and Ti individually comprise between 0.01 and 0.5 wt % of the alloy; and wherein when present, Ru and Pd individually comprise between 0.1 and 5 wt % of the alloy.

6. An iridium alloy according to claim 3, wherein W comprises between 0.01 and 0.5 wt % of the alloy.

7. An iridium alloy according to claim 4, wherein W comprises between 0.01 and 0.5 wt % of the alloy.

8. In iridium alloy according to claim 1, wherein W comprises between 0.02 and 2.0 wt % of the alloy.

9. In iridium alloy according to claim 3, wherein W comprises between 0.02 and 2.0 wt % of the alloy.

10. In iridium alloy according to claim 4, wherein W comprises between 0.02 and 2.0 wt % of the alloy.

11. An alloy comprising an iridium alloy consisting essentially of iridium, Rh, W, Zr, Pt, and one or more elements selected from the group consisting of Ta, Nb, Mo, Cr, Ce, Sc, Lu, Co, Ni, Hf, Y, Ti, Ru and Pd individually in an amount of between 0.01 and 10 wt % of the alloy; wherein the Rh comprises between 0.1 and 2.5 wt % of the alloy; wherein W comprises between 0.01 and 5 wt % of the alloy; wherein Zr comprises between 0.01 and 0.5 wt % of the alloy; and wherein Pt comprises between 0.1 and 5 wt % of the alloy.

12. An iridium alloy according to claim 11, wherein W comprises between 0.01 and 0.5 wt % of the alloy.

13. An iridium alloy according to claim 11, wherein W comprises between 0.02 and 2.0 wt % of the alloy.

14. An alloy according to claim 11, wherein when present, Ta, Nb, Mo, Cr, Ce, Sc, Lu, Co, Ni, Hf, Y and Ti individually comprise between 0.01 and 0.5 wt % of the alloy; and wherein when present, Ru and Pd individually comprise between 0.1 and 5 wt % of the alloy.

* * * * *